United States Patent [19]

Kobayashi

[11] Patent Number: 4,973,053

[45] Date of Patent: Nov. 27, 1990

[54] ACTION TOY GAME DEVICE

[75] Inventor: Toshio Kobayashi, Chiba, Japan

[73] Assignee: Asahi Corporation, Tokyo, Japan

[21] Appl. No.: 433,892

[22] Filed: Nov. 9, 1989

[30] Foreign Application Priority Data

Mar. 8, 1989 [JP] Japan ..... 1-26280[U]

[51] Int. Cl.[5] ..... A63F 9/00

[52] U.S. Cl. ..... 273/1 GG

[58] Field of Search ..... 273/1 GE, 1 GG, 1 GF, 273/1 GC, 1 GD

[56] References Cited

U.S. PATENT DOCUMENTS

| | | | |
|---|---|---|---|
| 3,036,834 | 5/1962 | Zalkind | 273/1 GF |
| 3,565,440 | 2/1971 | Glass et al. | 273/1 GG X |
| 3,687,451 | 8/1972 | Breslow | 273/1 GG |
| 3,721,440 | 3/1973 | Burns | 273/1 GG |
| 4,784,387 | 11/1988 | Liversidge | 273/1 GF X |

OTHER PUBLICATIONS

Sears Christmas Book 1968, 9-1968, p. 482, BASH #49N65025.

*Primary Examiner*—Paul E. Shapiro

*Attorney, Agent, or Firm*—Salter & Michaelson

[57] ABSTRACT

An action toy game device includes a base, a timer on the base, a plurality of disc-like game elements, a game element retaining mechanism, a game element engaging mechanism and a game element ejecting mechanism. For use of the game device the timer is actuated for a set period of time and the game elements are removably retained and rotated in a substantially vertical stack by the game element retaining mechanism. The engaging mechanism is then manipulated by a game player for individually engaging the game elements so that they are removed from the stack. In the event that all of the game elements have not been removed from the stack upon the expiration of the set period of time, the remaining game elements and the retaining mechanism are ejected by the ejecting mechanism.

21 Claims, 4 Drawing Sheets

ACTION TOY GAME DEVICE

BACKGROUND AND SUMMARY OF THE INVENTION

The instant invention relates to toy amusement games and more particularly to a toy game device of the general type wherein a game player must perform certain prespecified manipulative activities within a set period of time in order to achieve a game score.

Game devices which incorporate amusing and interesting themes and which require game players to perform skillful manipulations to achieve game scores have generally been found to have relatively high levels of play value. Further, game devices of this type which require game players to perform game activities within set periods of time have been found to have particularly high levels of appeal. For example, the devices disclosed in the applicants U.S. Pat. Nos. 4,783,074; 4,802,668; 4,826,160; and 4,826,176 and patent applications Ser. Nos. 07/273,221; 07/273,222; and 07/273,223 have been found to be highly popular and to have high levels of amusement value. In this regard, the devices disclosed in these patents and patent applications require game players to perform various prespecified game activities within set periods of time and they are adapted to incorporate various different and amusing types of action movements. For these reasons, they have generally been found to be successful and popular game devices. However, while the devices disclosed in the applicant's aforesaid U.S. patents represent the closest prior art to the subject invention of which the applicant is aware, they fail to suggest a device having the novel and amusing features of the game device of the subject invention and hence they are believed to be of only general interest with respect thereto.

The instant invention provides an effective and amusing game device which is operative with interesting and amusing forms of game movements and which requires game players to perform skillful manipulations to achieve game scores. Specifically, the game device of the instant invention is preferably adapted to incorporate a "lumber jack" theme wherein a game player must manipulate a lumber jack character to chop down a tree within a set period of time in order to prevent the tree and a buzzard character figure on the tree from being ejected upon the expiration of the set period of time. The toy game device of the instant invention comprises a base, a timer on the base which is actuatable for a set period of time, a plurality of game elements which are receivable in a substantially vertical stack, game element retaining means on the base for removably retaining the game elements in stacked relation during the set period of time and game element engaging means which is actuatable by a game player for engaging the game elements to individually remove them from the stack during the set period of time. The game elements preferably comprise game element discs having outwardly opening slots therein and the game elements are preferably supported in stacked relation on the base. The game element retaining means preferably comprises a substantially vertical post which is removably receivable in the slots in the game elements with the game elements assembled in a substantially verticle stack on the base. The post is preferably operatively connected to the timer for rotating the post and any game elements received thereon during the set period of time. The game element retaining means is preferably operable for rotating the stack of game elements during the set period of time and for retaining the game elements so that they are individually removable from the stack by individually moving each game element so that the post passes outwardly through the respective slot therein. The game element retaining means preferably further comprises a cap on the post which in engageable with the uppermost game element in the stack of game elements for further retaining the game elements on the base. The cap preferably includes a secondary character figure and it preferably descends with the uppermost game element in the stack as the game elements are individually removed from the lower portion of the stack. The toy game device preferably further includes means for ejecting both the retaining means and any game elements remaining in the stack upon the expiration of the set period of time in the event that all of the game elements have not been removed from the stack. The game element engaging means preferably includes a primary character figure which is pivotable about a substantially vertical axis for individually engaging game elements as they descend to an engagement station above the base. The primary character figure is preferably biased to a position of engagement with the game element located at the engagement station at any given time and manually pivotable away from the engagement station so that when released, the primary character figure is propelled into engagement with the game element located at the engagement station for removing it from the stack.

It has been found that the instant invention provides an effective toy game device which has a high level of play value. Specifically, it has been found that the toy game device of the instant invention is adapted to effectively incorporate an interesting game theme and that it can be effectively utilized for playing a challenging and amusing game. More specifically, it has been found that a significant amount of amusement can be derived from manipulating the primary character figure to individually engage the game elements so that they are removed from the stack as the timer is advanced toward an unwound position.

Accordingly, it is a primary object of the instant invention to provide a toy game device wherein game elements are individually removed from a stack of game elements during a set period of time.

Another object of the instant invention is to provide a toy game device which is adapted to incorporate a novel and interesting game theme.

An even further object of the instant invention is to provide a novel and amusing toy game device of the general type wherein a game player must perform certain prespecified manipulative activities within a set period of time in order to achieve a game score.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
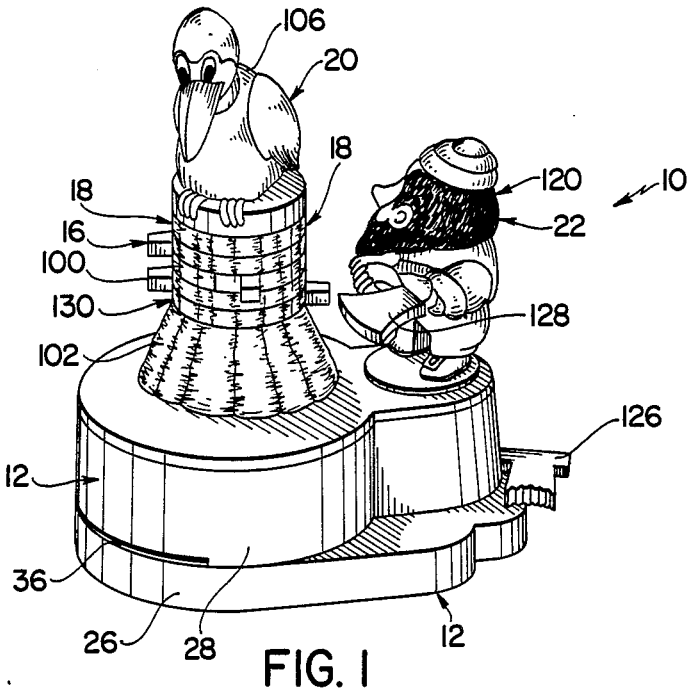
FIG. 1 is a perspective view of the toy game device of the instant invention.
Figure 2:
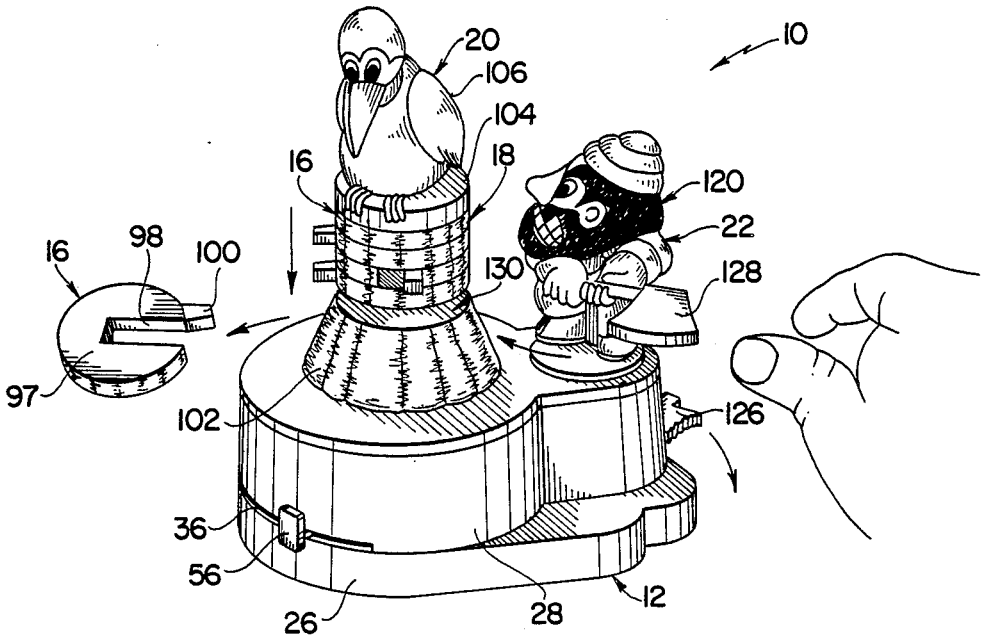
FIG. 2 is a similar perspective view illustrating the operation of the engaging mechanism to individually remove game elements from a stack of game elements.
Figure 3:
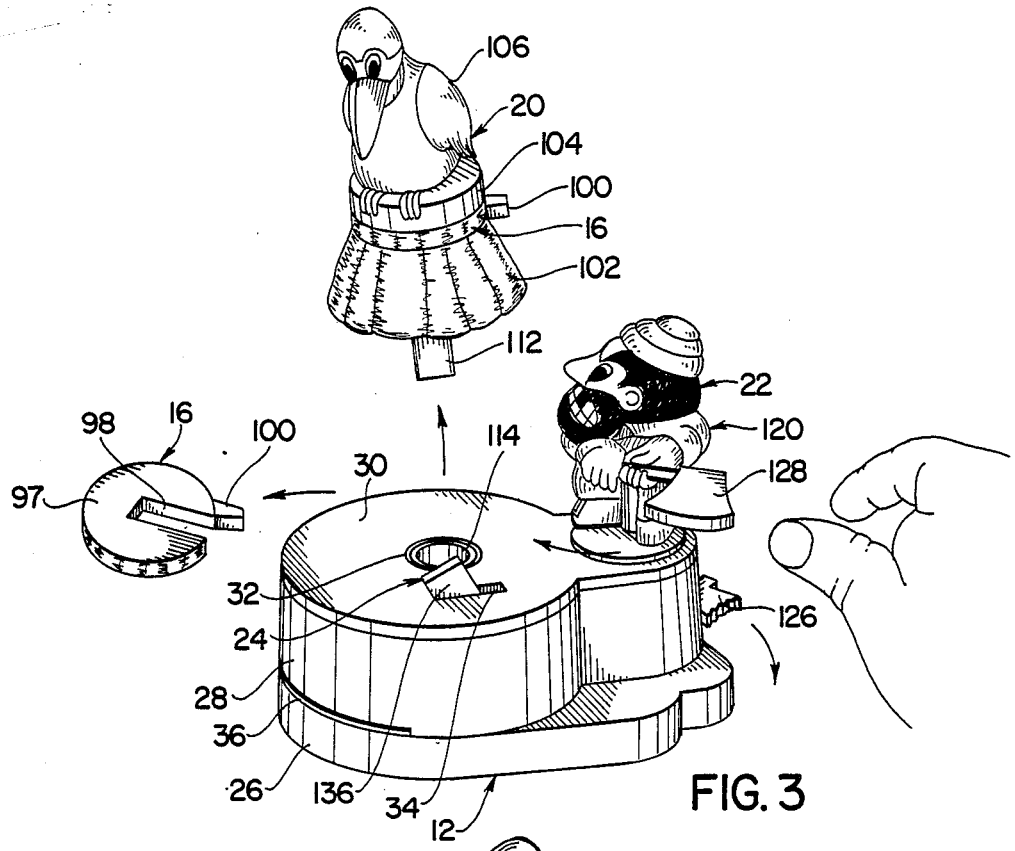
FIG. 3 is a perspective view illustrating the operation of the ejecting mechanism.
Figure 4:
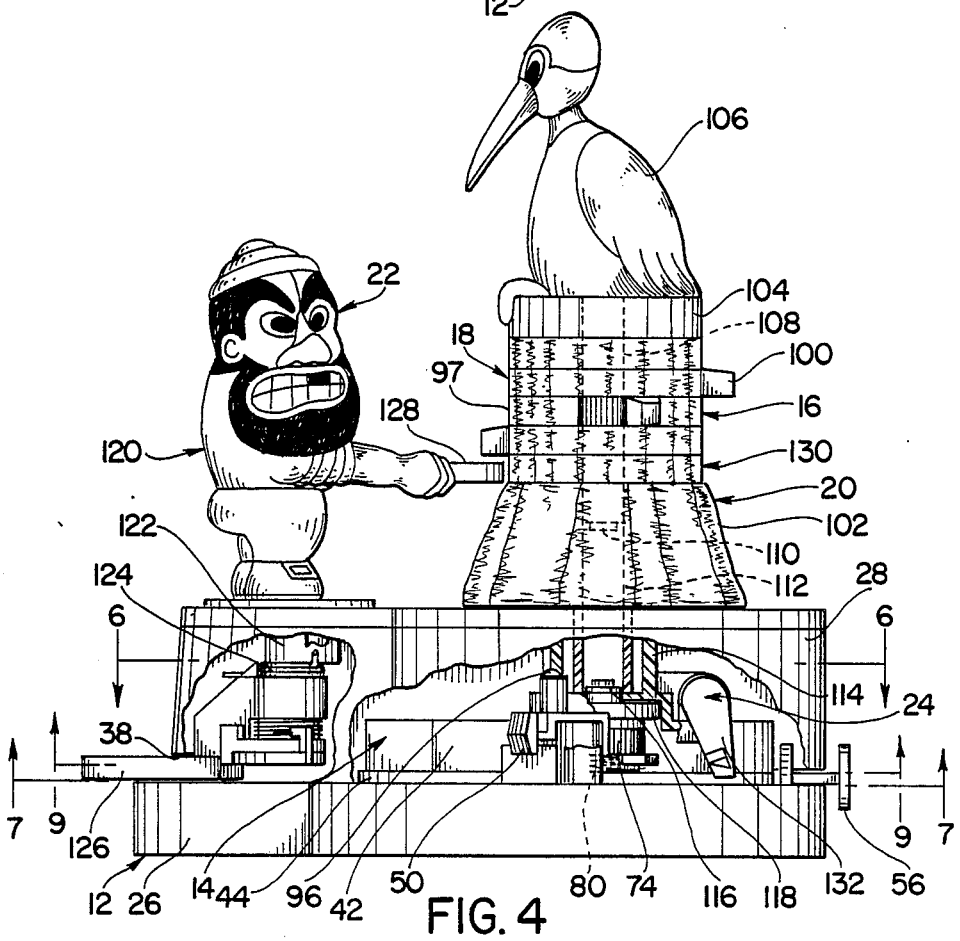
FIG. 4 is a side elevational view of the toy game device shown in partial section.

Referring now to the drawings, the toy game device of the instant invention is illustrated in FIGS. 1–9 and generally indicated at 10 in FIGS. 1–5. The toy game device 10 comprises a base generally indicated at 12, a timer assembly generally indicated at 14 in the base 12, a plurality of game elements 16 which are receivable in a stack generally indicated at 18 above the base 12, a game element retaining mechanism generally indicated at 20, a game element engagement mechanism generally indicated at 22, and a game element ejecting mechanism generally indicated at 24. During operation of the toy game device 10 the game elements 16 are assembled with the retaining mechanism 20 so that the game elements 16 are positioned in the substantially vertical stack 18. The timer 14 is then actuated for a set period of time and the game element engaging mechanism 22 is manipulated for individually engaging the game elements 16 to remove them from the stack 18. In the event that all of the game elements 16 have not been removed from the stack 18 before the expiration of the set period of time, the ejecting mechanism 24 is operative for ejecting the retaining mechanism 20 and any game elements 16 remaining in the stack 18.

The base 12 is preferably made from a suitable plastic material and it includes lower and upper base sections 26 and 28, respectively, and an upper wall 30 having a central opening 32, an ejection slot 34 and an engagement character opening (not shown) therein. The upper and lower housing sections 28 and 26, respectively, cooperate to define a timer arm slot 36 in the base 12 as well as an engagement mechanism slot 38.

Figure 6:
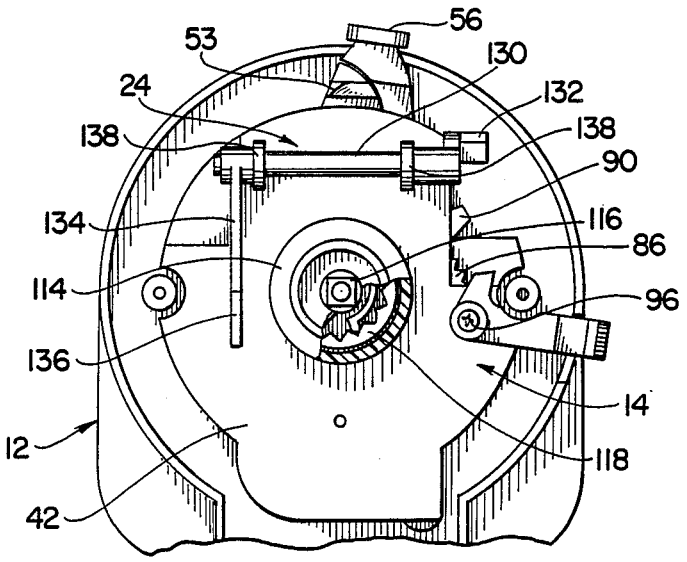
FIG. 6 is a sectional view taken along line 6—6 in FIG. 4.
Figure 7:
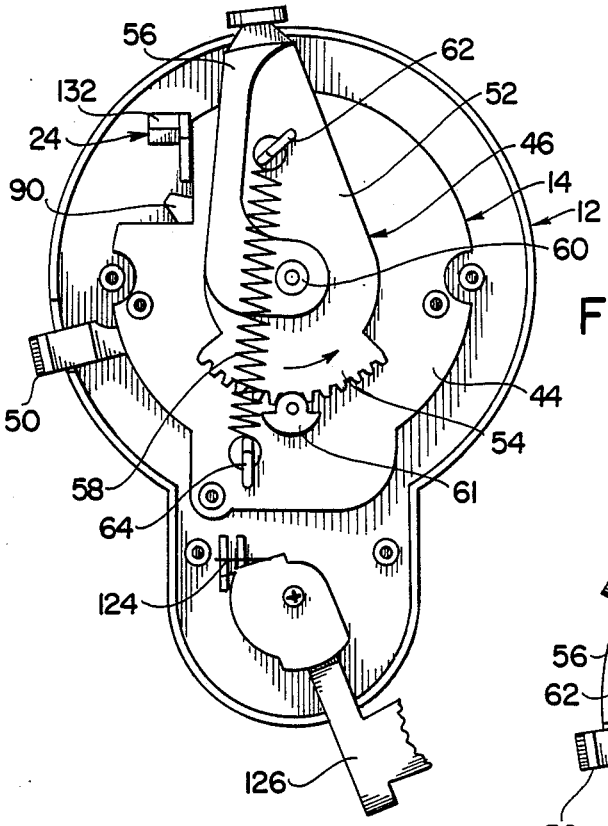
FIG. 7 is a sectional view taken along line 7—7 in FIG. 4.
Figure 8:
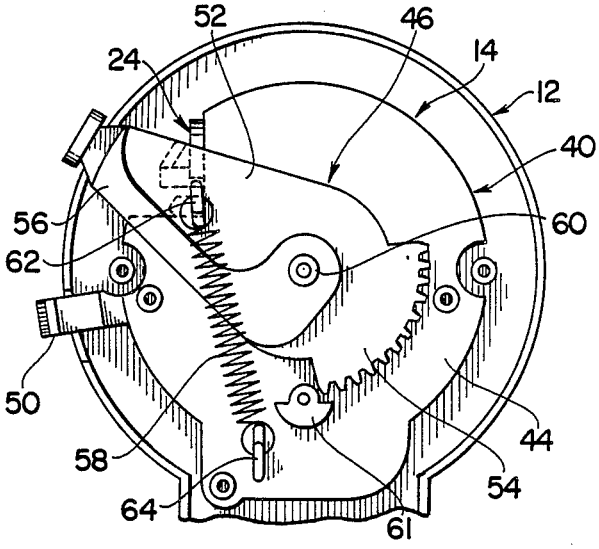
FIG. 8 is a similar sectional view with the timer in an unwound position.

The timer 14 is illustrated most clearly in FIGS. 6–9 and it includes a timer housing generally indicated at 40 including a main upper timer housing section 42 and a bottom wall 44. The timer 14 further includes a winding assembly generally indicated at 46 which is mounted on the underside of the bottom wall 44, a decay mechanism 48 which is mounted in the interior of the housing 40 and a stop lever 50. The winding mechanism 46 includes a main winding arm 52 having an upwardly extending leg 53 and a fan gear 54 thereon, a secondary winding arm 56 and a biasing spring 58. The main and secondary winding arms 52 and 56, respectively, are mounted on a boss 60 on the wall 44 so that the secondary winding arm 56 is operative for advancing the main winding arm 52 in a clockwise direction with respect to the timer 14 as it is illustrated in FIGS. 7–8. However, the secondary winding arm 56 is independently moveable in a counterclockwise direction so that it can not be utilized for advancing the main winding arm 52 in a clockwise direction. The main winding arm 52 is mounted on the wall 44 so that the fan gear 54 passes through a main drive gear housing 61 as the main winding arm 52 is rotated about the boss 60. The spring 58 is assembled on lugs 62 and 64 on the main winding arm 52 and the bottom wall 14, respectively, for biasing the main winding arm 52 and the secondary winding arm 56 in a counter clockwise direction with respect to the timer assembly 14 as it is illustrated in FIGS. 7–8.

Figure 9:
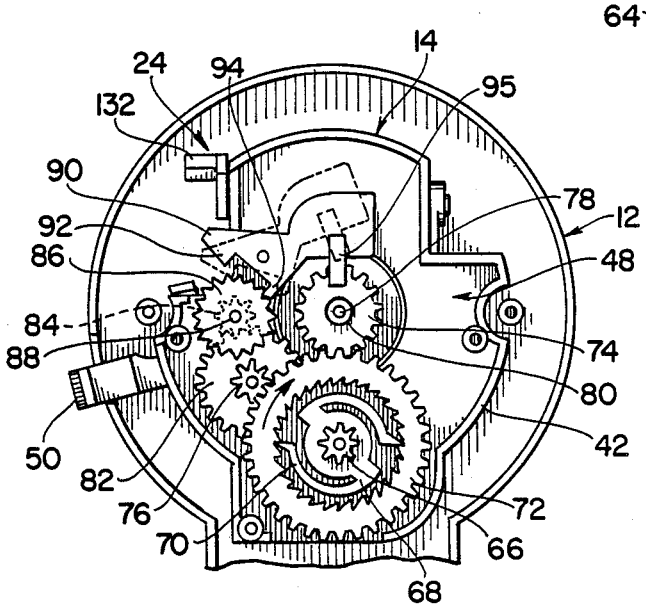
FIG. 9 is a sectional view taken along line 9—9 in FIG. 4.

The decay mechanism 48 is illustrated most clearly in FIG. 8–9 and it comprises a main drive gear 66 which is received in the drive gear housing 61 and integrally formed with a ratchet ring 68 having a pair of ratchet arms 70. The ratchet ring 68 is received in the interior of a ratchet ring gear 72 so that the ratchet ring 68 is engageable with the gear 72 for rotating the gear 72 in a clockwise direction but not in a counter clockwise direction. The ratchet ring gear 72 intermeshes with a retaining mechanism drive gear 74 and a main transmission gear 76. The retaining mechanism drive gear 74 is mounted on a shaft 78 having a coil spring 80 received thereon which biases the drive gear 74 upwardly. However, the retaining mechanism drive gear 74 is downwardly moveable slightly against the force of the spring 80 as will hereinafter be more fully set forth. The main transmission gear 76 is integrally formed with a secondary transmission gear 82 which intermeshes with an escapement wheel gear 84. The escapement wheel gear 84 is integrally formed with an escapement wheel 86 and coaxially mounted therewith on a shaft 88. Also included in the decay mechanism 48 is an escapement member 90 having jaws 92 and 94 which are alternately engageable with different teeth on the escapement wheel 86 for oscillating the escapement member 90 back and forth. Accordingly, as the decay mechanism 48 is advanced toward an unwound position the escapement member 90 and the escapement wheel 86 cooperate to retard the advancement of the timer 14. The stop lever 50 is mounted with a screw 96 on the upper housing section 42 so that it is pivotable between an "on" position wherein it is disengaged from the escapement wheel 86 and an "off" position wherein it engages the escapement wheel 86 to prevent further advancement of the timer 14.

During normal operation of the timer assembly 14 the winding arm 52 is advanced towards a wound position against the force of the spring 58 by moving the secondary winding arm 56 in a clockwise direction with respect to the timer assembly 14 as illustrated in FIGS. 7–8. When the secondary winding arm 56 is then released, the main winding arm 52 is advanced in a counter clockwise direction by the spring 58 so that the fan gear 54 passes through the housing 61 to rotate the main drive gear 66. As the main drive gear 66 is rotated in this manner, the decay mechanism 48 operates to retard the rotation of the main drive gear 66 and the advancement of the main winding arm 52 toward an unwound position.

Referring to FIGS. 2–5, the game elements 16 each preferably comprise a substantially flat circular disc 97 having an outwardly opening slot 98 therein and a projection 100 which extends outwardly from the disc 97 adjacent the mouth of the slot 98 therein. The game elements 16 are constructed so that they are receivable in a substantially vertical stack 18 so that the projections 100 extend outwardly from various parts of the stack 18.

The retaining mechanism 20 comprises a retaining mechanism base 102 which is formed in the configuration of a tree stump, an upper cap 104 and a secondary character FIG. 106. The cap 104 is preferably of substantially the same diameter as the game elements 16 and the secondary character FIG. 106 is preferably formed in the configuration of an amusing character, such as a buzzard as illustrated. The retaining mechanism 20 further includes a post 108 of substantially square cross section which extends downwardly from the cap 104, a stop element 110 on the lower end of the post 108 and a tubular element 112 which is mounted in the interior of the base 102 so that it extends downwardly therethrough. The tubular element 112 is of substantially square cross section and it is dimensioned for receiving the post 108 therein. Also included in the retaining mechanism 20 is a guide tube 114 which is integrally formed on the upper wall of the timer housing 40 and a substantially square lug 116. The lug 116 is formed on the top of a slip clutch 118 which is mounted on the shaft 78 so that the lug 116 and the slip clutch 118 rotate with the retaining mechanism drive gear 74. The tubular element 112 is dimensioned and configured to be non-rotatably received on the lug 116 and the tubular element 112 on the retaining mechanism base 102 are constructed so that when the retaining mechanism base 102 is received on the base 12 in the manner illustrated in FIGS. 1, 2 and 4, the lower end of the tubular element 112 is receivable on the lug 116 so that the retaining mechanism base 102 rotates with the lug 116 as the timer 14 is advanced toward an unwound position. The post 108 is dimensioned and configured so that it is receivable in non-rotatable but longitudinally slidable relation in the tubular element 112. The retaining assembly 20 is constructed so that the game elements 16 are receivable between the cap 104 and the retaining mechanism base 102 with the post 108 passing downwardly through the slots 98 in the game elements 16. Accordingly, during normal operation of the game device 10, the retaining mechanism base 102, the game elements 16, the cap 104, the secondary character FIG. 106, the tubular element 112 and the post 108 are all rotated by the lug 116 as the timer 14 is advanced toward an unwound position. However, the post 108 is dimensioned so that when the last game element 16 is removed from between the retaining mechanism base 102 and the cap 104, the stop element 110 engages the lug 116 so that the weight of the cap 104 and the character FIG. 106 move the lug 116 downwardly. This causes the retaining element drive gear 74 to be moved downwardly so that it engages the tab 95 on the escapement member 90 to arrest further movement of the escapement member 90. As a result, when the stop element 110 on the post 108 moves the lug 116 downwardly, the gear 74 engages the tab 95 to arrest further advancement of the timer mechanism 14 toward an unwound position.

The engaging mechanism 22 is illustrated in FIGS. 1–5 and it includes a primary character figure element generally indicated at 120, a substantially vertical shaft 122, a biasing spring 124 and an actuating lever 126. The character figure element 120 is preferably formed in the configuration of a lumber jack having an axe 128 and it is mounted on the shaft 122 so that it is pivotable about a substantially vertical axis. The biasing spring 122 biases the character figure element 120 to the position illustrated in FIG. 4 wherein the axe 128 is engageable with a game element 16 located at an engagement station generally indicated at 130. The engagement station 130 is defined by the location of the lower most game element 16 in the stack 18, i.e., the location of the game element 16 resting directly on the retaining mechanism base 102. Accordingly, each time one of the game elements 16 is removed from the stack 18 at the engagement station 130, a new game element 16 descends to the station 130 until all of the game elements 16 have been removed from the stack. The axe 128 is constructed to that it is engageable with the game element 16 located at the engagement station 130 for removing the game element 16 at the station 130 from the stack 18. The actuating lever 126 extends outwardly through the slot 38 so that it is manually manipulatable by an operator. The actuating lever 126 communicates with the shaft 122 so that it is operative for pivoting the primary character FIG. 120 against the force of the biasing spring 124 so that the axe 128 is moved away from the stack 18. Accordingly, by pivoting the character FIG. 120 to the position illustrated in FIG. 2, wherein the axe 128 is pivoted away from the stack 18, and then releasing the actuating lever 126 the character FIG. 120 is pivoted by the biasing spring 124 toward the position illustrated in FIG. 4 so that the axe 128 is propelled into engagement with the game element 16 at the engagement station 130. Further, by properly timing the release of the actuating lever 126 the axe 128 can be propelled into engagement with the projection 100 on the game element 16 located at the engagement station 130 so that the game element 16 located at the engagement station 130 is removed from the stack 18 by moving the game element 16 so that the post 108 passes outwardly through the slot 98 therein.

Figure 5:
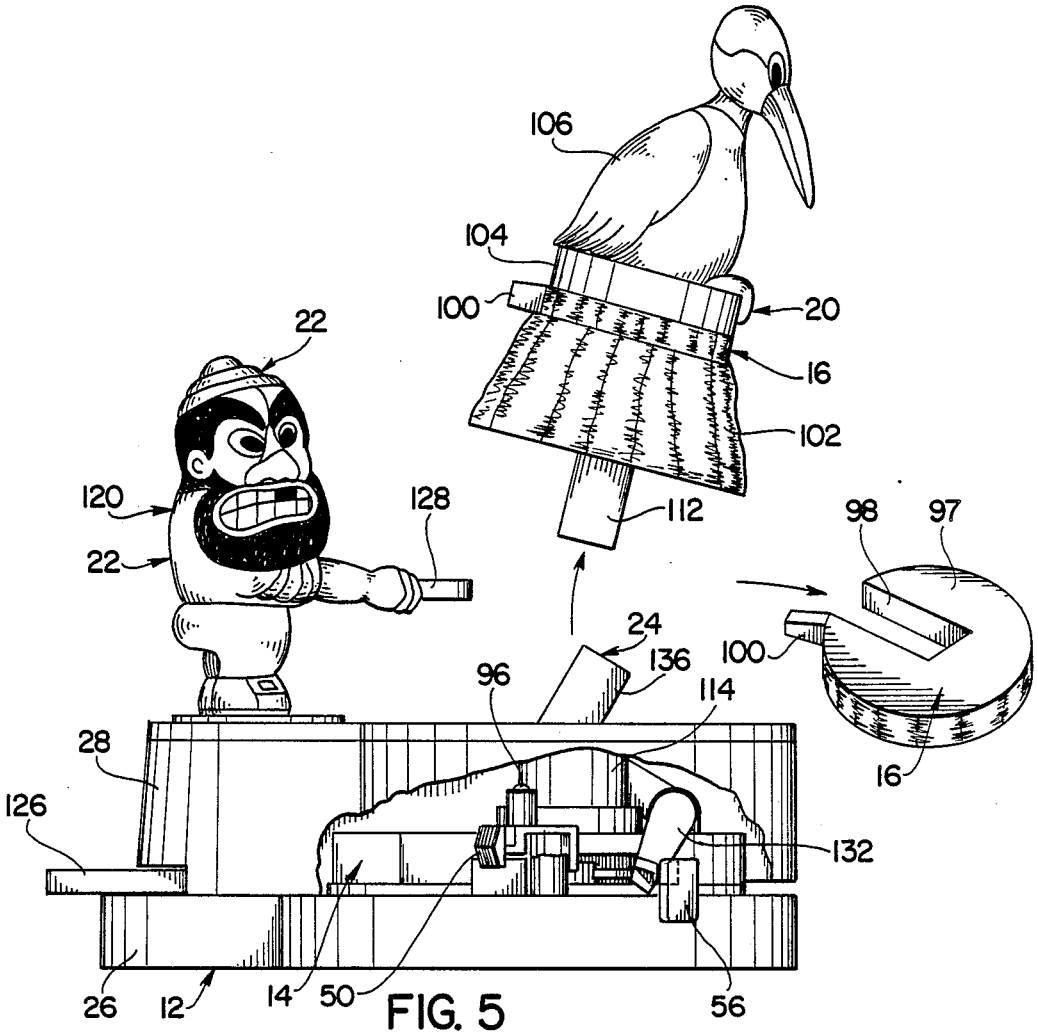
FIG. 5 is a similar side elevational view illustrating the ejecting mechanism.

The ejecting mechanism 24 is illustrated most clearly in FIGS. 5–6 and it includes a shaft 130, a downwardly extending lever arm 132 on one end of the shaft 130 and an ejecting arm 134 having an upwardly extending tab 136 on the opposite end of the shaft 130. The shaft 130 is rotatably mounted in a pair of mounts 138 on the upper side of the timer housing 40 so that the lever arm 132 is engageable by the upwardly extending leg 53 as the main winding arm 52 approaches an unwound position. The ejection assembly 24 is constructed so that when the lever arm 132 is engaged by the leg 53 in this manner the shaft 130 is rotated to pivot the ejection arm 134 upwardly so that the tab 136 is rapidly moved upwardly into engagement with the underside of the retaining mechanism base 102. This causes the retaining mechanism 20 and any of the game elements 16 remaining in the stack 18 to be propelled upwardly from the base 12 in the manner illustrated in FIG. 5. However, in the event that all of the game elements 16 have been removed from the stack 18 before the timer 14 reaches a fully unwound position the tab 95 on the escapement member 90 engages the drive gear 74 to prevent further advancement of the timer 14 so that the ejecting mechanism 24 is never actuated and the retaining mechanism 20 remains in an assembled position on the base 12.

Accordingly, for use and operation of the game device 10 the timer assembly 14 is moved to a wound position by advancing the position of the secondary winding arm 56 in the slot 36 and then moving the stop lever 50 to an "off" position. The game elements 16 are then assembled in a stack 18 so that they are received between the cap 104 and the retaining mechanism base 102 on the base 12. The stop arm 50 is then moved to an "on" position so that the timer is advanced towards an unwound position by the spring 58 causing the retaining mechanism 20 and the stack 18 to be rotated on the base 12. The actuating lever 126 is then manipulated by a game player to pivot the character FIG. 120 so that the axe 128 is pivoted outwardly away from the stack 18. The actuating lever 126 is then released when the tab 100 of the game element 16 located at the engagement station 130 is in a position wherein is it engageable by the axe 128 in order to remove the game element 16 from the stack 18 so that the next sequential game element 16 descends to the engagement station 130. This procedure is then repeated until all of the game elements 16 have been removed from the stack 18. However, if all of the game elements 16 have not been removed from the stack 18 before the timer 14 reaches a fully unwound position the ejecting lever 134 is pivoted upwardly causing the tab 136 to engage the underside of the retaining mechanism base portion 102 so that the retaining mechanism 20 and any of the game elements remaining in the stack 18 are ejected from the base 12.

It is seen therefore that the instant invention provides an effective toy game device. The game device 10 is adapted to be manipulated by a game player for performing an amusing and interesting game. In this regard, the game device 10 as herein embodied incorporates an amusing game theme wherein a lumber jack character figure must chop down a tree stump before the timer assembly 14 reaches an unwound position in order to prevent the tree stump and a buzzard character thereon from being ejected from the base 12. In order for the lumber jack character figure to chop down the tree stump a game player must skillfully manipulate the actuating lever 126 so that the axe 128 engages the game elements 16 which are sequentially located at the engagement station 130 at the appropriate times so that the game elements 16 are removed from the stack 18. Accordingly, it is seen that the game device 10 has a high level of amusement value and that it therefore represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy game device comprising a base, timer means on said base actuatable for a set period of time, game element means including a plurality of game elements which are removably receivable in stacked relation, game element retaining means on said base removably retaining said game elements in a substantially vertical stack during said set period of time, and game element engaging means actuatable by a game player for engaging said game elements to remove them from said stack during said set period of time.

2. In the toy game device of claim 1, said game element retaining means retaining said game elements so that they are individually removable from said stack during said set period of time, said game element engaging means being actuatable for individually engaging said game elements to remove them from said stack during said set period of time.

3. In the toy game device of claim 2, said game elements further characterized as game element discs which are receivable in a substantially vertical stack on said base.

4. In the toy game device of claim 3 said game elements each having an outwardly opening slot therein, said game element retaining means being received in said slots for releasably retaining said game elements in said stack.

5. In the toy game device of claim 4, said game elements each being individually removable from said game element retaining means by individually moving each said game element so that said retaining means passes outwardly through the slot therein.

6. In the toy game device of claim 5, said game element retaining means comprising a substantially vertical post, said post being removably receivable in the slots in said game elements with said game elements assembled in said stack for retaining said game elements so that they are individually removable from said stack.

7. In the toy game device of claim 6, said game element retaining means further comprising cap means on said post engageable with the uppermost game element in said stack for further retaining said game elements in said stack.

8. In the toy game device of claim 7, said cap means descending with the uppermost game element in said stack as game elements are individually removed from said stack.

9. In the toy game device of claim 7, said game element retaining means including a secondary character figure element on said cap means.

10. In the toy game device of claim 6, said game element engaging means being pivotable about a substantially vertical axis for engaging said game elements.

11. In the toy game device of claim 10, said game element engaging means including a primary character figure element which is pivotable about said axis for engaging said game elements.

12. In the toy game device of claim 11, means for biasing said primary character figure element to a position of engagement with one of said game elements located at an engagement station and being pivotable away from said game element located at said engagement station and releasable so that it is propelled by said biasing means into engagement with said game element located at said engagement station.

13. In the toy game device of claim 12, said game element retaining means causing sequential game elements to descend to said engagement station as each game element located at said engagement station is engaged by said engaging means and thereby removed from said stack.

14. In the toy game device of claim 1, said game elements further characterized as game element discs which are receivable in a substantially vertical stack on said base.

15. The toy game device of claim 1 further comprising ejecting means for ejecting any game elements remaining in said stack upon the expiration of said set period of time.

16. In the toy game device of claim 15, said ejecting means also ejecting said game element retaining means upon the expiration of said set period of time in the event that all of said game elements have not been removed from said stack.

17. In the toy game device of claim 1, said game element engaging means being pivotable about a substantially vertical axis for individually engaging said game elements.

18. In the toy game device of claim 17, said game element engaging means including a primary character figure element which is pivotable about said axis for engaging said game elements.

19. In the toy game device of claim 1, said game element retaining means communicating with said timer means for rotating the game elements in said stack during said set period of time.

20. In the toy game device of claim 19, each of said game elements including an outwardly extending projection which is engageable by said engaging means for removing each said game element from said stack.

21. In the toy game device of claim 20, said retaining means positioning said game elements so that the lowermost game element in said stack is positioned at an engagement station, said engaging means only being engageable with said game elements when they are located at said engagement station.

* * * * *